US008221947B2

(12) United States Patent
Lambert et al.

(10) Patent No.: US 8,221,947 B2
(45) Date of Patent: Jul. 17, 2012

(54) TONER SURFACE TREATMENT

(75) Inventors: Patrick M. Lambert, Rochester, NY (US); Bret M. Johnston, Dansville, NY (US)

(73) Assignee: Eastman Kodak Company, Rochester, NY (US)

( * ) Notice: Subject to any disclaimer, the term of this patent is extended or adjusted under 35 U.S.C. 154(b) by 716 days.

(21) Appl. No.: 12/337,712

(22) Filed: Dec. 18, 2008

(65) Prior Publication Data

US 2010/0159377 A1 Jun. 24, 2010

(51) Int. Cl.
*G03G 9/00* (2006.01)

(52) U.S. Cl. ..... 430/108.6; 430/108.7

(58) Field of Classification Search ..... 430/108.6, 430/108.7; 106/286.6, 688; 23/295 R, 313 R
See application file for complete search history.

(56) References Cited

U.S. PATENT DOCUMENTS

| | | | | |
|---|---|---|---|---|
| 4,473,029 | A | 9/1984 | Fritz et al. | |
| 4,531,832 | A | 7/1985 | Kroll et al. | |
| 4,546,060 | A | 10/1985 | Miskinis et al. | |
| 4,666,813 | A | 5/1987 | Sakashita | |
| 4,702,986 | A | 10/1987 | Imai et al. | |
| 5,024,915 | A | 6/1991 | Sato et al. | |
| 5,376,492 | A | 12/1994 | Stelter et al. | |
| 5,385,798 | A | 1/1995 | Law et al. | |
| 5,397,667 | A | 3/1995 | Law et al. | |
| 5,763,130 | A | 6/1998 | Sasaki et al. | |
| 6,120,744 | A | 9/2000 | Teles et al. | |
| 2003/0134217 | A1 * | 7/2003 | Combes et al. | 430/108.11 |
| 2003/0190543 | A1 | 10/2003 | Sugiura et al. | |
| 2005/0058924 | A1 | 3/2005 | Miyakawa | |
| 2006/0063094 | A1 | 3/2006 | Eida | |

FOREIGN PATENT DOCUMENTS

| | | |
|---|---|---|
| EP | 0 774 696 | 6/2001 |

OTHER PUBLICATIONS

B. D. Cullity, "Introduction to Magnetic Materials" Addison-Wesley Publishing Company, 1972, p. 18.

* cited by examiner

*Primary Examiner* — Thorl Chea
(74) *Attorney, Agent, or Firm* — Andrew J. Anderson

(57) ABSTRACT

The present invention is directed to surface treatment of toner particles and the toner developers used for the dry development of electrostatic charge images.

11 Claims, 12 Drawing Sheets

TONER SURFACE TREATMENT

FIELD OF THE INVENTION

The present invention relates to electrophotography and more particularly it relates surface treatment of toner particles and the toner developers used for the dry development of electrostatic charge images.

BACKGROUND OF THE INVENTION

In electrophotography, an electrostatic charge image is formed on a dielectric surface, typically the surface of the photoconductive recording element. Development of this image is typically achieved by contacting it with a two-component developer comprising a mixture of pigmented resinous particles, known as toner, and magnetically attractable particles, known as carrier. The carrier particles serve as sites against which the non-magnetic toner particles can impinge and thereby acquire a triboelectric charge opposite to that of the electrostatic image. During contact between the electrostatic image and the developer mixture, the toner particles are stripped from the carrier particles to which they had formerly adhered (via triboelectric forces) by the relatively strong electrostatic forces associated with the charge image. In this manner, the toner particles are deposited on the electrostatic image to render it visible.

It is generally known to apply developer compositions of the above type to electrostatic images by means of a magnetic applicator, also known as a magnetic brush, which comprises a cylindrical sleeve of non-magnetic material having a magnetic core positioned therein. The core usually comprises a plurality of parallel magnetic strips arranged around the core surface to present alternating north and south oriented magnetic fields. These fields project radially, through the sleeve, and serve to attract the developer composition to the sleeve outer surface to form what is commonly referred to in the art as a "brush" or "nap." Both the cylindrical sleeve and the magnetic core may be rotated with respect to each other to cause the developer to advance from a supply sump to a position in which it contacts the electrostatic image to be developed. After development, the toner depleted carrier particles are returned to the sump for toner replenishment.

Conventionally, carrier particles made of soft magnetic materials have been employed to carry and deliver the toner particles to the electrostatic image. U.S. Pat. Nos. 4,546,060, 4,473,029 and 5,376,492, the teachings of which are incorporated herein by reference in their entirety, teach use of hard magnetic materials as carrier particles and also apparatus for development of electrostatic images utilizing such hard magnetic carrier particles. These patents require that the carrier particles comprise a hard magnetic material that when magnetically saturated exhibits a coercivity of at least 300 Oersteds and induced magnetic moment of at least 20 EMU/gm in an applied magnetic field of 1000 Oersteds. The terms "hard" and "soft" when referring to magnetic materials have the generally accepted meaning as indicated on page 18 of Introduction To Magnetic Materials by B. D. Cullity published by Addison-Wesley Publishing Company, 1972. These hard magnetic carrier materials represent a great advance over the use of soft magnetic carrier materials in that the speed of development is remarkably increased with good image development. Speeds as high as four times the maximum speed utilized in the use of soft magnetic carrier particles have been demonstrated.

In the methods taught by the foregoing patents, the developer is moved in the same direction as the electrostatic image to be developed by high-speed rotation of the multi-pole magnetic core within the sleeve, with the developer being disposed on the outer surface of the sleeve. Rapid pole transitions on the sleeve are mechanically resisted by the carrier because of its high coercivity. The nap, also called "tstrings" or "chains", of carrier (with toner particles disposed on the surface of the carrier particles), rapidly "flips" on the sleeve in order to align with the magnetic field reversals imposed by the rotating magnetic core, and as a result, moves with the toner on the sleeve through the development zone in contact with or close relation to the electrostatic image on a photoconductor. This interaction of the developer with the charge image is referred to as "contact" or "contacting" herein for purposes of convenience. See also, U.S. Pat. No. 4,531,832, the teachings of which are also incorporated herein in their entirety, for further discussion concerning such a process.

The rapid pole transitions, for example as many as 467 per second at the sleeve surface when the magnetic core is rotated at a speed of 2000 revolutions per minute (rpm), create a highly energetic and vigorous movement of developer as it moves through the development zone. This vigorous action constantly recirculates the toner to the sleeve surface and then back to the outside of the nap to provide toner for development. This flipping action thus results in a continuous feed of fresh toner particles to the image. As described in the above-described patents, this method provides high density, high quality images at relatively high development speeds.

U.S. Pat. Nos. 4,666,813 and 5,024,915 teach the use of silica as a surface treatment and that the silica may include a fine powder of anhydrous silicon dioxide (silica) or silicates such as aluminum silicate, sodium silicate, potassium silicate, magnesium silicate and zinc silicate.

U.S. Pat. No. 5,763,130 mentions zinc silicate as a possible surface treatment with a preference given to those containing not less than 85% by weight $SiO_2$.

US Patent Application 2003/0190543A1 describes doping silica with Zn via the hydrolyzing flame process (fumed silica) followed by silicone coating.

US Patent Application 2005/0058924A1 describes a toner for electrophotography in which hydrophobic fine particles obtained by coating fine silica particles with a hydroxide or an oxide of one or more of titanium, tin, zirconium and aluminum in an aqueous system, and further coating surfaces thereof with an alkoxysilane are used as an external additive.

EP 774696B1 describes the preparation of crystalline strontium silicate surface treatment.

U.S. Pat. No. 5,385,798 describes colloidal silicas treated with boric acid or salts such as lithium sodium and other alkalis.

U.S. Pat. No. 5,397,667 describes surface treated silicas. Specifically, this reference describes metallized silica preparation via neutralization of acid groups on R972 with lithium, sodium and potassium hydroxides. The metallized surface is then treated with a long chain alcohol.

SUMMARY OF THE INVENTION

This invention relates surface treatment of toner particles and the toner developers used for the dry development of electrostatic charge images.

One embodiment of the present invention encompasses a method of treating toner particles comprising forming a mixture of silica and zinc salt and a solvent, drying the mixture, grinding the dried mixture, heating the mixture at a temperature of from 200 to 900° C. to form a surface treatment, and surface treating the toner.

Another embodiment of the present invention encompasses a method of treating toner particles comprising forming a mixture of silica and zinc salt and a solvent, drying the mixture, grinding the dried mixture, heating the mixture at a temperature of from 400 to 650° C. to form a surface treatment and surface treating the toner.

A further embodiment of the present invention encompasses a a method of treating toner particles comprising forming a mixture of silica and zinc salt and methanol, drying the mixture, grinding the dried mixture, heating the mixture at a temperature of from 200 to 900° C. to form a surface treatment, and surface treating the toner Another embodiment of the present invention encompasses a surface treatment for toner particles comprising silica and zinc silicate wherein treatment exhibits a fourier transform infrared major peak at 940 cm−1 and a weaker peak at 560 cm−1 and is amorphous to X-rays.

The present invention also encompasses a surface treatment for toner particles comprising fumed silica and zinc silicate wherein treatment exhibits a fourier transform infrared major peak at 940 cm−1 and a weaker peak at 560 cm−1 and is amorphous to X-rays.

A further embodiment of the present invention encompasses a developer for developing electrostatic latent images, comprising toner particles and a surface treatment comprising silica and amorphous zinc silicate.

The present invention also encompasses a developer for developing electrostatic latent images, comprising toner particles and a surface treatment comprising fumed silica and amorphous zinc silicate.

Another embodiment of the present invention encompasses toner comprising toner particles and a surface treatment comprising silica and amorphous zinc silicate.

Another embodiment of the present invention encompasses toner comprising toner particles and a surface treatment comprising finned silica and amorphous zinc silicate.

These and other aspects, objects, features and advantages of the present invention will be more clearly understood and appreciated from a review of the following detailed description of the preferred embodiments, the Figures, and appended claims.

Figure 1:
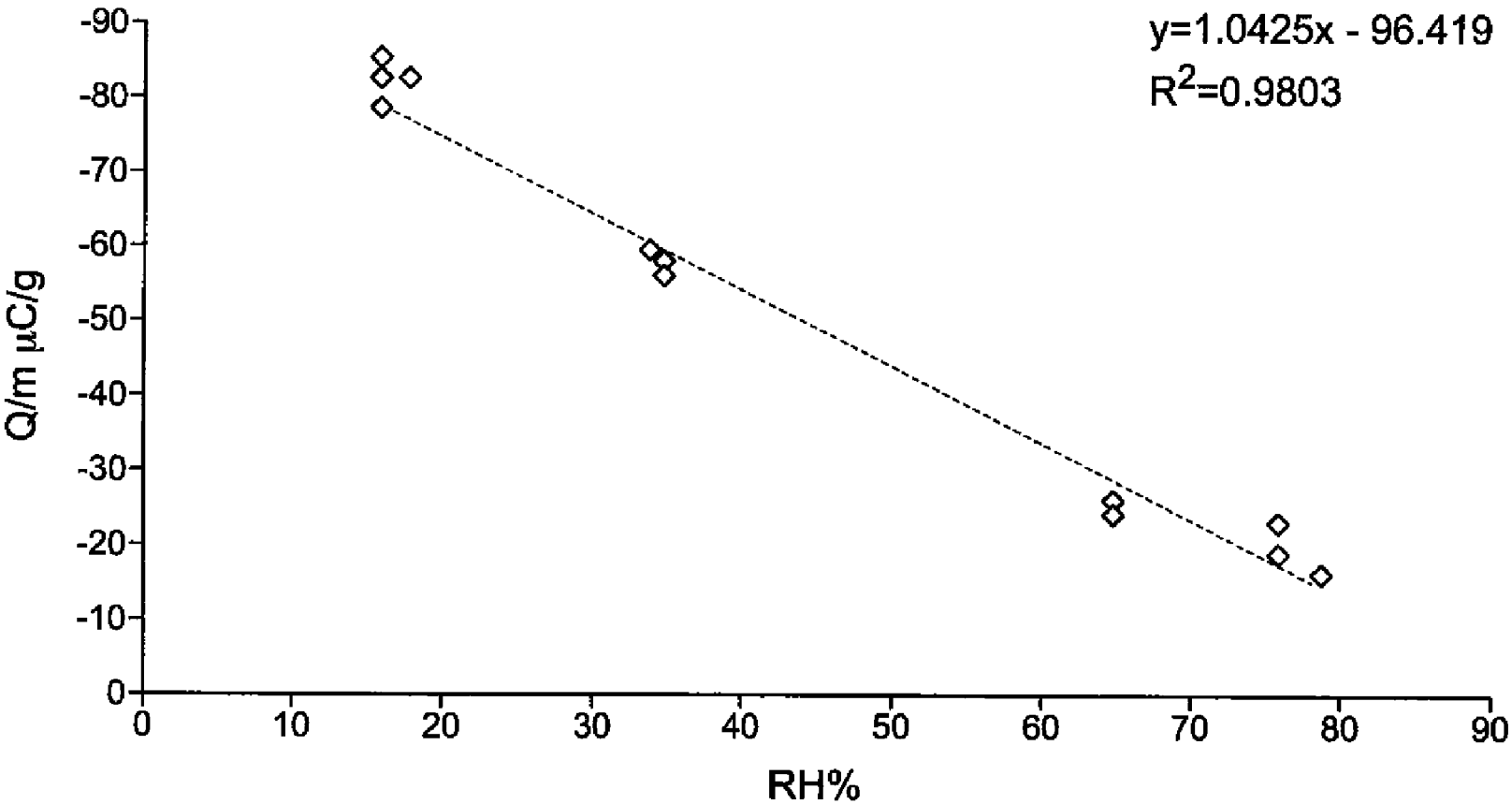
FIG. 1 PRIOR ART
FIG. 1 shows the relative humidity relationship of toners and developers surface treated with silica of the prior art.

For better understanding of the present invention, together with other advantages and capabilities thereof, reference is made to the following detailed description in connection with the above-described drawings.

DETAILED DESCRIPTION OF THE INVENTION

The present invention relates to developers used in a development system as well as the toner in the developer.

In more detail, the present invention, in part, relates to a surface treatment for toners. Silicas, fumed or colloidal, are commonly used for surface treatment of toner particles to imbue these particles with increased flow and/or tribocharging characteristics. Most silicas, in their application as toner surface treatment, tend to exhibit an RH dependence to their tribocharging. At high RH conditions, the tribocharge is lower on toners treated with uncoated or surface coated silicas, while higher charges are observed for dry, or low RH conditions. The RH dependence impacts preparation of developers, where the build RH conditions then determine the early life charging performance. For example, developers built at high RH will charge low and frequently result in a high dusting of the toner when introduced into the toning station.

More significant is the impact of a high RH tribocharging dependence on the toning process within an electrophotographic copier or printer. The impact can be minimized to an extent by conditioning the air circulating within the machine. The machine temperature and relative humidity can be controlled to preferred setpoints reducing the impact of any RH sensitivity in the developer. This hardware increases the cost and complexity of the printer. Local area temperature fluctuations can still modulate the relative or absolute humidity within the machine and allow the developer tribocharge to swing. For machines with a minimum of air conditioning, in which the purpose is solely to exhaust contaminants from the electrophotographic process or maintain a temperature/humidity range, the issue of RH dependent tribocharging is critical. Since toner tribocharge interacts with the fields essential to deposit and transfer the toner, the electrophotographic process is then required to accommodate this variability. Ideally, the latitude of the photoconductor response and the development bias system is dedicated to adjusting for image requirements and component aging. If a significant portion of this latitude is directed to compensating for toner tribocharges, the output performance of the printer is compromised.

A typical development system contains a supply of dry developer mixture which includes toner and hard magnetic carrier particles. A non-magnetic, cylindrical shell which can be a stationary shell or a rotating shell is used for transporting the developer mixture from the supply to the development zone. A magnetic core which includes a plurality of magnetic pole portions is arranged around the core periphery in alternating magnetic polarity relation and which is rotatable on an axis within the non-magnetic, cylindrical shell. Furthermore, means for rotating the core and optionally the shell are present in order to deliver the developer mixture to the development zone wherein the toner of the developer is transferred to the electrostatic image.

A typical development system includes a fuser roll that is coated with a silicone rubber or other low surface energy elastomer, fluoroplastic or resin. The fuser roll is preferably in a pressure contact arrangement with a backup or pressure roll. In this assembly, both the fuser roll and the pressure roll are pressed against each other under sufficient pressure to form a nip. It is in this nip that the fusing or fixing takes place. The toner particles that are used in the development system preferably contains at least one toner resin, release agent(s), surface treatment agent(s), optionally colorant(s), charge control agent(s), other conventional toner components, or combinations thereof.

The set up of the development system is preferably a digital printer, such as a Heidelberg Digimaster 9110 printer using a development station comprising a non-magnetic, cylindrical shell, a magnetic core, and means for rotating the core and optionally the shell as described, for instance, in detail in U.S. Pat. Nos. 4,473,029 and 4,546,060, both incorporated in their entirety herein by reference. The development systems described in these patents can be adapted for use in the present invention. In more detail, the development systems described in these patents preferably use hard magnetic carrier particles. For instance, the hard magnetic carrier particles, when magnetically saturated, can exhibit a coercivity of at least about 300 gauss and an induced magnetic moment of at least about 20 EMU/gm when in an externally applied field of 1,000 gauss. The magnetic carrier particles can be binder-less carriers or composite carriers. Useful hard magnetic materials include ferrites and gamma ferric oxide. Preferably, the carrier particles are composed of ferrites, which are compounds of magnetic oxides containing iron as a major metallic component. For example, compounds of ferric oxide, $Fe_2O_3$, formed with basic metallic oxides such as those having the general formula $MFeO_2$ or $MF_2O_4$ wherein M represents a mono- or di-valent metal and the iron is in the oxidation state of +3. Preferred ferrites are those containing barium and/or strontium, such as $BaFe_{12}O_{19}$, SrFe12$O_{19}$, and the magnetic ferrites having the formula MO.6 $Fe_2O_3$, wherein M is barium, strontium, or lead as disclosed in U.S. Pat. No. 3,716,630 which is incorporated in its entirety by reference herein. The size of the magnetic carrier particles useful in the present invention can vary widely, and preferably have an average particle size of less than 100 microns, and more preferably have an average carrier particle size of from about 5 to about 45 microns.

An example of a suitable release agent is one or more waxes. Useful release agents are well known in this art. Useful release agents include low molecular weight polypropylene, natural waxes, low molecular weight synthetic polymer waxes, commonly accepted release agents, such as stearic acid and salts thereof, and others.

The toner particles can include one or more toner resins which can be optionally colored by one or more colorants by compounding the resin(s) with at least one colorant and any other ingredients. Although coloring is optional, normally a colorant is included and can be any of the materials mentioned in Colour Index, Volumes and II, Second Edition, incorporated herein by reference. The toner resin can be selected from a wide variety of materials including both natural and synthetic resins and modified natural resins as disclosed, for example, in U.S. Pat. Nos. 4,076,857; 3,938,992; 3,941,898; 5,057,392; 5,089,547; 5,102,765; 5,112,715; 5,147,747; 5,780,195 and the like, all incorporated herein by reference. Preferred resin or binder materials include polyesters and styrene-acrylic copolymers. The shape of the toner particles can be any shape, regular or irregular, such as spherical particles, which can be obtained by spray-drying a solution of the toner resin in a solvent. Alternatively, spherical particles can be prepared by the polymer bead swelling techniques, such as those described in European Patent No. 3905 published Sep. 5, 1979, which is incorporated in its entirety by reference herein.

Typically, the amount of toner resin present in the toner formulation is from about 80% to about 95% by weight of the toner formulation.

In a typical manufacturing process, the desired polymeric binder for toner application is produced. Polymeric binders for electrostatographic toners are commonly made by polymerization of selected monomers followed by mixing with various additives and then grinding to a desired size range. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of toner addenda into the bulk of the polymer.

The polymer may be made using a limited coalescence reaction such as the suspension polymerization procedure disclosed in U.S. Pat. No. 4,912,009 to Amering et al., which is incorporated in its entirety by reference herein.

Useful binder polymers include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Other examples include fusible styrene-acrylic copolymers that are covalently lightly crosslinked with a divinyl compound such as divinylbenzene. Binders of this type are described, for example, in U.S. Reissue Pat. No. 31,072, which is incorporated in its entirety by reference wherein. Preferred binders comprise styrene and an alkyl acrylate and/or methacrylate and the styrene content of the binder is preferably at least about 60% by weight.

Copolymers rich in styrene such as styrene butylacrylate and styrene butadiene are also useful as binders as are blends of polymers. In such blends, the ratio of styrene butylacrylate to styrene butadiene can be 10:1 to 1:10. Ratios of 5:1 to 1:5 and 7:3 are particularly useful. Polymers of styrene butylacrylate and/or butylmethacrylate (30 to 80% styrene) and styrene butadiene (30 to 80% styrene) are also useful binders.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders. Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol, and bisphenols.

A useful binder can also be formed from a copolymer of a vinyl aromatic monomer; a second monomer selected from either conjugated diene monomers or acrylate monomers such as alkyl acrylate and alkyl methacrylate.

The term "charge-control" refers to a propensity of a toner addendum to modify the triboelectric charging properties of the resulting toner. A very wide variety of optional charge control agents for positive and negative charging toners are available and can be used in the toners of the present invention. Suitable charge control agents are disclosed, for example, in U.S. Pat. Nos. 3,893,935; 4,079,014; 4,323,634; 4,394,430; and British Patent Nos. 1,501,065 and 1,420,839, all of which are incorporated in their entireties by reference herein. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl)azo]-3-hydroxy-N-phenyl-2-naphthalenecarb oxamidato(2-)], ammonium, sodium, and hydrogen (Organoiron available from Hodogaya Chemical Company Ltd.).

An optional additive for the toner is a colorant. In some cases the magnetic component, if present, acts as a colorant negating the need for a separate colorant. Suitable dyes and pigments are disclosed, for example, in U.S. Reissue Pat. No. 31,072 and in U.S. Pat. Nos. 4,160,644; 4,416,965; 4,414,152; and 2,229,513, all incorporated in their entireties by reference herein. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent. The toner formulations can also contain other additives of the type used in conventional toners, including magnetic pigments, colorants, leveling agents, surfactants, stabilizers, and the like.

The remaining components of toner particles as well as the hard magnetic carrier particles can be conventional ingredients. For instance, various resin materials can be optionally used as a coating on the hard magnetic carrier particles, such as fluorocarbon polymers like poly (tetrafluoro ethylene), poly(vinylidene fluoride) and polyvinylidene fluoride-co-tetrafluoroethlyene). Examples of suitable resin materials for the carrier particles include, but are not limited to, silicone resin, fluoropolymers, polyacrylics, polymethacrylics, copolymers thereof, and mixtures thereof, other commercially available coated carriers, and the like.

The present invention can be further clarified by the following examples, which are intended to be purely exemplary of the present invention.

Preparation

The majority of the example preparations were done with Aerosil 130 (Degussa) untreated hydrophilic fumed silica with a surface area of 130 $m^2/g$. The salts were dissolved in deionized (DI) water or methanol (ACS reagent) at loadings ranging from 1 to 50 pph relative to silica. Normally 10 g of silica were combined with 100 ml of solution in a large evaporating dish with magnetic stirring and/or spatula mixing. The mixture at these ratios was usually a thick slurry or paste. Refinements include homogenation of the mixture with a Silverstone mixer that thinned the slurry considerably and improved the dispersion of cations through the silica matrix.

After air drying, the silica matrix was ground in a Waring blender at 20,000 rpm, or in a Trost jet mill. The resulting treated silica could be applied directly to a ground toner in a Waring blender to evaluate the room temperature version of the formulation or calcined in an oven, box furnace or tube furnace at temperatures form 200-900° C. for 1-3 hours. The resulting treated silica was reground in either a Waring Blender, Trost or ball mill to eliminate large agglomerates. This fine powder was then used to surface treat 10-25 g of ground toner in a Waring Blender at 20,000 rpm for 1-2 minutes at loadings from 0.5 to 5 wt %. In these examples, a magenta polyester 8μ ground toner is used.

Testing

Four (4) gram developer samples were prepared at 16% by weight toner concentration (TC) with a hard ferrite carrier. Carrier and toner incubated overnight at each specific environment. The carrier was prepared by combining a 60/40 weight percent mixture of Kynar 301 (Elf AtoChem North America) and poly-(methylmethacryate) MP 1201 (Soken) at a total addenda level of 1.25 pph relative to the weight of an uncoated $SrFe_{12}O_{19}$ core from Powdertech Japan (PTK). The mixture of ferrite and polymers is roll milled for 15 minutes, sieved, and roll milled for another 15 minutes. The mixture is cured between 175 and 260° C. for 1-3 hours. After curing, the carrier is sieved though a 230 Mesh screen.

Each sample was exercised on a in a 4 dram vial placed on a shell containing a multipole magnetic core rotating at 2000 rpm for 10 minutes.

The toner was stripped from the developer on a concentric shell of a minibrush comprised of an internal rotating multipole magnetic core and an outside shell which is at ground relative to the concentric shell. The toner was stripped under the influence of an electric field of 5000V.

The remaining carrier form the toner stripping was rebuilt to 6% TC with fresh toner. Half of the rebuilt developer was separated and used for a throwoff measurement which is a measure of the dusting performance of a developer. The developer is exercised in a 4 dram vial for 2 minutes on a wrist shaker, a mechanical device which simulated the action of shaking the material. An additional 4 wt % toner is added to the exercised developer, shaken for 30 seconds, and then applied to a minibrush setup as described above. No bias is applied to the concentric shell and the toner that deposited on the outside shell after a 1 minute exercise at 2000 rpm is weighed. This is a measure of the dusting performance of the developer and toner. High throwoff values indicate a propensity for higher dusting.

The second portion of the rebuilt developer is exercised in a 4 dram vial placed on a shell containing a multipole magnetic core rotating at 2000 rpm for 10 minutes. The charge on the exercised developer is then measured.

Charge measurement—the toner Q/m ratio is measured in a MECCA device comprised of two spaced-apart, parallel, electrode plates which can apply both an electrical and magnetic fields to the developer samples, thereby causing a separation of the two components of the mixture, i.e., carrier and toner particles, under the controlling influence of a magnetic and electric field. A 0.1 to 0.2 g sample of developer mixture is placed on the bottom metal plate. The sample is then subjected for forty seconds to a 60 Hz magnetic field and potential of 2000V across the plates, which causes developer agitation. The toner particles are released from the carrier particles under the combined influence of the magnetic and electric fields and are attached to and thereby deposit on the upper electrode plate, while the magnetic carrier particles are held to the bottom plate. An electrometer measures the accumulated charge of the toner on the upper plate. The toner Q/m ratio in terms of microcoulombs per gram (μC/g) is calculated by dividing the accumulated charge by the mass of the deposited toner on the upper plate.

Chamber conditions nominally set for 55/15, 70/35 and 85/80 (F/RH)

Results

A production polyester control was processed with each set of samples. The A0069-105 control is an 8μ magenta toner surface treated with 1.2 wt % R972 (dimethyldichlorosilane treated). Results can be seen in Table 1. The charge-to-mass measurement for each Temp/RH condition is shown along with the measured toner concentration (TC) and the throwoff amount (mg). The figure of merit for RH dependence is "RH Slope" which is the range of tribocharge divided by the RH range $((Q/m_{Low\ Rw}-Q/m_{High\ RH})/(\text{Low RH}-\text{High RH}))$. It is understood that there are deficiencies to this calculations; the assumption of linearity and the absence of a reference to the tribocharging level. Low charging toners can display excellent RH dependence using this figure of merit, however, the associated throwoff values are usually very high, and so identify such materials as impractical.

TABLE 1

| Prior Art Controls | | | | | | | | | | | | | |
|---|---|---|---|---|---|---|---|---|---|---|---|---|---|
| Comp Ex | Temp/ RH | Q/M | TC | T.O. | Temp/ RH | Q/M | TC | T.O. | Temp/ RH | Q/M | TC | T.O. | RH slope |
| A | 58/16 | −78.3 | 5.9 | 0.3 | 71/34 | −59.7 | 5.8 | 0.2 | 80/79 | −16.2 | 4.7 | 2.0 | 0.986 |
| B | 58/16 | −78.8 | 6.1 | 0.4 | 76/35 | −56.3 | 5.9 | 0.0 | 80/65 | −26.3 | 6.2 | 1.8 | 1.071 |
| C | 58/16 | −82.8 | 5.6 | 0.0 | 76/35 | −56.3 | 5.9 | 0.0 | 80/76 | −18.9 | 5.5 | 2.3 | 1.065 |
| D | 58/16 | −85.4 | 5.8 | 0.3 | 76/35 | −58.1 | 6.0 | 0.4 | 80/76 | −23.0 | 5.2 | 1.6 | 1.040 |
| E | 58/18 | −82.6 | 5.6 | 0.0 | 76/35 | −56.0 | 6.0 | 0.0 | 80/65 | −24.4 | 4.8 | 3.2 | 1.238 |

FIG. 1 shows the linear dependence to the relative humidity of toners surface treated with fumed silica. The modulation of Q/m with relative humidity will translate to concomitant toning potential swings within the electrophotographic process and constrict the practical operating window for toning bias and photoconductor response. There are significant implications to toner transfer processes as well. This can create problems for machines running in environments that do not control the relative humidity.

Aerosil 130 is the untreated source silica for R972 Aerosil. Samples were also prepared using a finer Aerosil 200 product (200 refers to surface area). Below, in Table 2, are untreated Aerosil 130 experiments at various processing conditions and 1 wt % loading relative to toner mass. The descriptions of the examples are

| | |
|---|---|
| F | Aerosil 130 - 1 wt % |
| G | Aerosil 130 aqueous wetted - dried 100° C. |
| H | Aerosil 130 aqueous wetted - fired 650° C. |
| I | Aerosil 130 6 hr ball mill |
| J | Aerosil 130 MeOH wetted - fired 650° C. |
| K | Aerosil 200 Aqueous wetted - fired 400° C. |

The drying ad firing times were 2 hours at the specified temperature.

TABLE 2

| Uncoated Silica Controls | | | | | | | | | | | | | |
|---|---|---|---|---|---|---|---|---|---|---|---|---|---|
| Comp Ex | Temp/ RH | Q/M | % TC | T.O. | Temp/ RH | Q/M | % TC | T.O. | Temp/ RH | Q/M | % TC | T.O. | RH slope |
| F | 59/15 | −46.7 | 6.0 | 0.4 | 72/29 | −34.2 | 6.0 | 0.5 | 80/76 | −8.4 | 5.8 | 54.8 | 0.628 |
| G | 59/17 | −49.0 | 5.7 | 0.2 | 72/29 | −35.6 | 4.9 | 0.7 | 80/79 | −13.7 | 5.9 | 78.3 | 0.569 |
| H | 58/16 | −53.9 | 6.1 | 0.3 | 76/35 | −39.6 | 5.2 | 0.6 | 80/79 | −16.0 | 4.7 | 33.9 | 0.602 |
| I | 58/16 | −56.8 | 5.8 | 0.3 | 76/35 | −33.3 | 6.1 | 0.5 | 80/79 | −14.6 | 3.6 | 46.3 | 0.670 |
| J | 59/15 | −45.8 | 6.0 | 0.2 | 72/29 | −37.9 | 5.6 | 0.3 | 80/76 | −14.9 | 4.7 | 35.1 | 0.507 |
| K | 57/32 | −55.5 | 5.6 | 0.2 | 69/44 | −50.9 | 5.7 | 0.4 | 82/88 | −28.0 | 5.8 | 2.8 | 0.491 |

Figure 2:
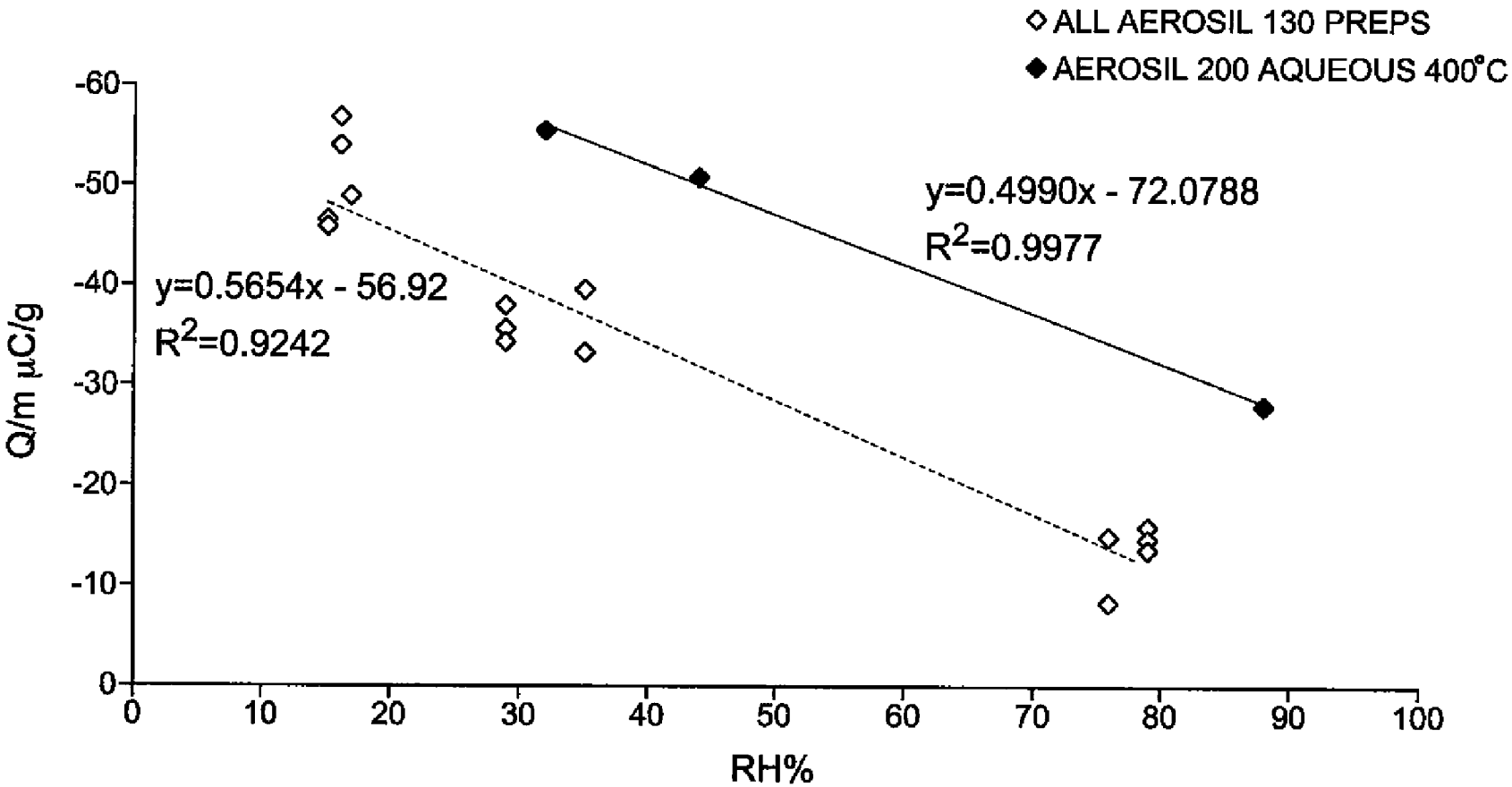
FIG. 2 PRIOR ART
FIG. 2 shows the relative humidity relationship of toners and developers surface treated with silica of the prior art.

Table 2 and FIG. 2 shows that the RH dependence is lower for the Aerosil 130 preparations, however, there does not appear to be much processing dependence. Solution treatment, aqueous or methanolic along with calcining does not affect the tribocharging level or RH trend. The use of the higher surface area Aerosil 200 shows an increase in absolute charging level without an increase in RH slope. Note, Aerosil 130 can be used as a surface treatment for toners, however, it has performance shortfalls in toner flow and charge stability.

Data

The formulations are described by the part per hundred (pph) loading of oxide that a particular source would yield through decomposition and/or dehydration. This designation does not imply a physical mixture of the oxide and the silica; in fact, FTIR (Fourier Transform infrared spectroscopy—diffuse reflectance mode) indicates the ZnO treatments yield a surface reaction rather than a separate phase.

Low levels of zinc oxide addition (pph) using a zinc acetate source in methanol are shown in Table 3 below.

TABLE 3

| ZnO addition from zinc acetate | | | | | | | | | | | | | | |
|---|---|---|---|---|---|---|---|---|---|---|---|---|---|---|
| DESCRIPTION | EX | Temp/ RH | Q/M | TC | T.O. | Temp/ RH | Q/M | TC | T.O. | Temp/ RH | Q/M | TC | T.O. | RH slope |
| 10 pph ZnO RT | 1 | 58/16 | −40.5 | 6.1 | 0.3 | 76/35 | −25.4 | 6.1 | 0.5 | 80/65 | −17.4 | 5.6 | 4.6 | 0.471 |
| 10 pph ZnO 200 C. | 2 | 58/16 | −27.5 | 5.4 | 0.6 | 76/35 | −20.2 | 4.4 | 2.1 | 80/76 | −10.6 | 6.3 | 19.4 | 0.282 |
| 5 pph ZnO 400 C. | 3 | 57/32 | −66.9 | 5.9 | 0.0 | 72/29 | −33.7 | 6.0 | 0.9 | 80/76 | −16.3 | 5.6 | 10.0 | 1.150 |
| 5 pph ZnO 650 C. | 4 | 57/32 | −66.9 | 5.9 | 0.0 | 72/29 | −36.3 | 5.7 | 1.0 | 80/76 | −14.2 | 5.2 | 39.5 | 1.197 |
| 10 pph ZnO 650 C. | 5 | 58/16 | −44.2 | 5.8 | 0.7 | 71/34 | −34.9 | 5.8 | 0.5 | 80/83 | −15.6 | 5.0 | 30.1 | 0.426 |

The results show a small decrease in RH sensitivity for 10 pph ZnO in methanol regardless of the processing conditions, while the 5 pph loading show an exaggerated RH dependence.

Zinc nitrate shows improved performance as a ZnO source especially at higher loadings and firing temperatures. The overall tribocharging level and RH dependence is influenced by the presence of the nitrate anion. The nitrate ion reduces the negative charge that the fumed silica normally delivers. At higher firing conditions this ion decomposes to yield the oxide. This transformation is mirrored in an increase in overall tribocharge and a reduction in the RH dependence. Several series of experiments using zinc nitrate are shown below in Table 4.

TABLE 4

| ZnO addition from Zinc Nitrate | | | | | | | | | | | | | | |
|---|---|---|---|---|---|---|---|---|---|---|---|---|---|---|
| DESCRIPTION | Ex | Temp/ RH | Q/M | TC | T.O. | Temp/ RH | Q/M | TC | T.O. | Temp/ RH | Q/M | TC | T.O. | RH Slope |
| 1 pph ZnO RT | 6 | 58/16 | −44.7 | 6.2 | 0.2 | 76/35 | −21.9 | 6.3 | 1.7 | 80/76 | −11.9 | 6.0 | 77.5 | 0.547 |
| 5 pph ZnO RT | 7 | 58/16 | −7.3 | 5.9 | 17.6 | 76/35 | −3.9 | 2.8 | 72.5 | 80/76 | −15.1 | 4.2 | 53.4 | −0.130 |
| 10 pph ZnO RT | 8 | 58/16 | −6.3 | 3.8 | 25.5 | 76/35 | −4.1 | 3.3 | 57.9 | 80/76 | 16.2 | 5.3 | 21.6 | 0.375 |
| 20 pph ZnO RT | 9 | 58/18 | 7.0 | 4.2 | 10.4 | 76/35 | 3.4 | 3.1 | 42.3 | 80/65 | 9.8 | 5.5 | 10.5 | 0.060 |
| 20 pph ZnO RT trosted | 10 | 58/18 | 7.0 | 4.4 | 14.0 | 76/35 | −3.9 | 3.3 | 72.5 | 80/65 | −7.5 | 5.1 | 11.3 | −0.309 |
| 30 pph ZnO RT | 11 | 58/18 | −3.6 | 5.1 | 46.5 | 76/35 | −4.5 | 4.2 | 91.9 | 80/65 | 11.1 | 5.5 | 9.3 | 0.313 |
| 50 pph ZnO RT | 12 | 58/18 | 4.4 | 4.7 | 100.0 | 76/35 | −9.3 | 3.9 | 44.6 | 80/65 | −7.9 | 5.6 | 59.9 | −0.262 |
| 1 pph ZnO 200 C. | 13 | 58/16 | −49.8 | 6.4 | 0.5 | 76/35 | −33.0 | 5.7 | 1.7 | 80/76 | −18.4 | 6.0 | 42.4 | 0.523 |
| 5 pph ZnO 200 C. | 14 | 58/16 | −27.8 | 6.2 | 0.5 | 76/35 | −17.3 | 4.4 | 2.1 | 80/76 | −17.4 | 5.6 | 58.8 | 0.173 |
| 10 pph ZnO 200 C. | 15 | 58/16 | −11.1 | 6.3 | 4.1 | 76/35 | −8.2 | 5.3 | 13.5 | 80/76 | −16.6 | 5.1 | 70.2 | −0.092 |
| 1 pph ZnO 400 C. | 16 | 58/16 | −55.6 | 6.0 | 0.3 | 76/35 | −37.9 | 5.6 | 1.1 | 80/76 | −22.2 | 5.8 | 32.0 | 0.557 |
| 5 pph ZnO 400 C. | 17 | 58/16 | −51.6 | 5.9 | 0.0 | 76/35 | −39.3 | 5.6 | 1.1 | 80/76 | −26.0 | 5.7 | 14.5 | 0.427 |
| 10 pph ZnO 400 C. | 18 | 58/16 | −47.1 | 6.0 | 0.3 | 76/35 | −42.1 | 5.0 | 0.7 | 80/76 | −25.0 | 5.8 | 8.4 | 0.368 |
| 20 pph ZnO 400 C. | 19 | 58/16 | −44.1 | 6.3 | 0.4 | 76/35 | −43.5 | 5.2 | 0.9 | 80/76 | −30.9 | 5.5 | 2.9 | 0.220 |
| 20 pph ZnO 400 C. | 20 | 58/18 | −45.4 | 5.9 | 1.2 | 76/35 | −47.0 | 4.4 | 1.3 | 80/65 | −36.7 | 5.4 | 2.8 | 0.185 |
| 30 pph ZnO 400 C. | 21 | 58/18 | −46.6 | 5.7 | 0.8 | 76/35 | −41.4 | 4.7 | 1.2 | 80/65 | −31.0 | 5.1 | 4.0 | 0.332 |
| 50 pph ZnO 400 C. | 22 | 58/18 | −40.3 | 5.9 | 0.9 | 76/35 | −32.0 | 5.3 | 1.4 | 80/65 | −22.7 | 5.4 | 4.0 | 0.374 |
| 5 pph ZnO 650 C. | 23 | 58/16 | −49.1 | 6.1 | 0.5 | 76/35 | −37.0 | 5.9 | 0.9 | 80/76 | −22.1 | 5.9 | 13.1 | 0.450 |
| 10 pph ZnO 650 C. | 24 | 58/16 | −41.1 | 6.1 | 0.4 | 76/35 | −33.0 | 5.4 | 0.8 | 80/76 | −25.6 | 5.4 | 8.0 | 0.258 |
| 10 pph ZnO 650 C. | 25 | 58/16 | −67.3 | 6.2 | 0.0 | 76/35 | −57.0 | 5.8 | 0.4 | 80/76 | −39.2 | 6.0 | 1.1 | 0.468 |
| 20 pph ZnO 650 C. | 26 | 58/16 | −34.5 | 6.0 | 1.1 | 76/35 | −26.5 | 5.3 | 1.4 | 80/76 | −23.7 | 5.6 | 6.2 | 0.180 |
| 20 pph ZnO 650 C. | 27 | 58/18 | −46.2 | 5.8 | 0.4 | 76/35 | −41.6 | 4.9 | 0.8 | 80/65 | −31.5 | 5.4 | 3.2 | 0.313 |
| 20 pph ZnO 650 C. 2% | 28 | 58/18 | −40.3 | 6.3 | 0.3 | 76/35 | −33.3 | 5.3 | 0.9 | 80/65 | −24.9 | 5.6 | 4.3 | 0.328 |
| 30 pph ZnO 650 C. | 29 | 58/18 | −55.7 | 5.1 | 0.2 | 76/35 | −43.7 | 4.4 | 0.6 | 80/65 | −29.8 | 5.3 | 1.9 | 0.551 |
| 50 pph ZnO 650 C. | 30 | 58/18 | −47.5 | 6.3 | 1.2 | 76/35 | −42.6 | 4.9 | 1.5 | 80/65 | −33.9 | 5.5 | 2.1 | 0.289 |

Figure 3:
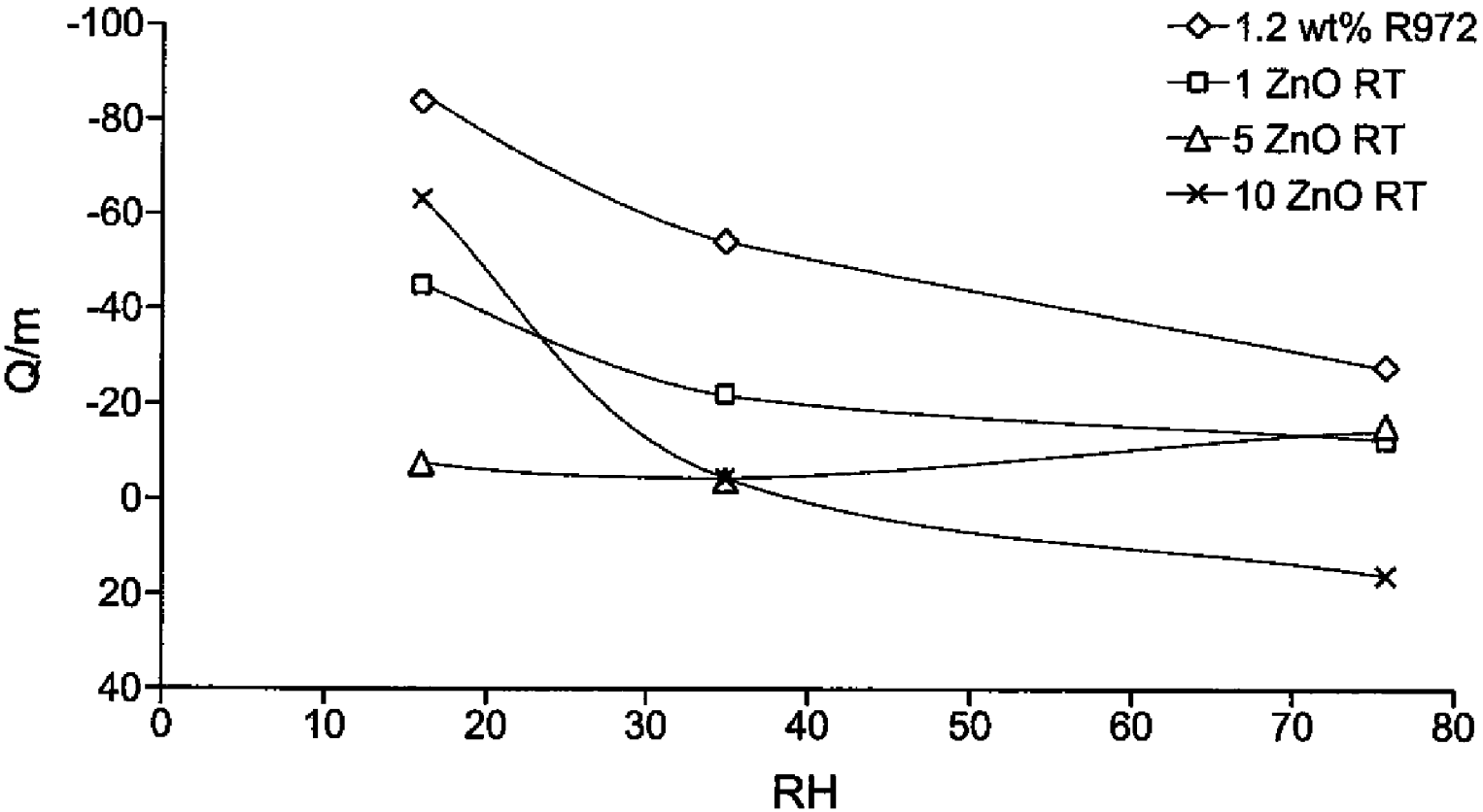
FIG. 3 shows the relative humidity relationship of toners and developers surface treated with silica and zinc oxide processed at room temperature.
Figure 4:
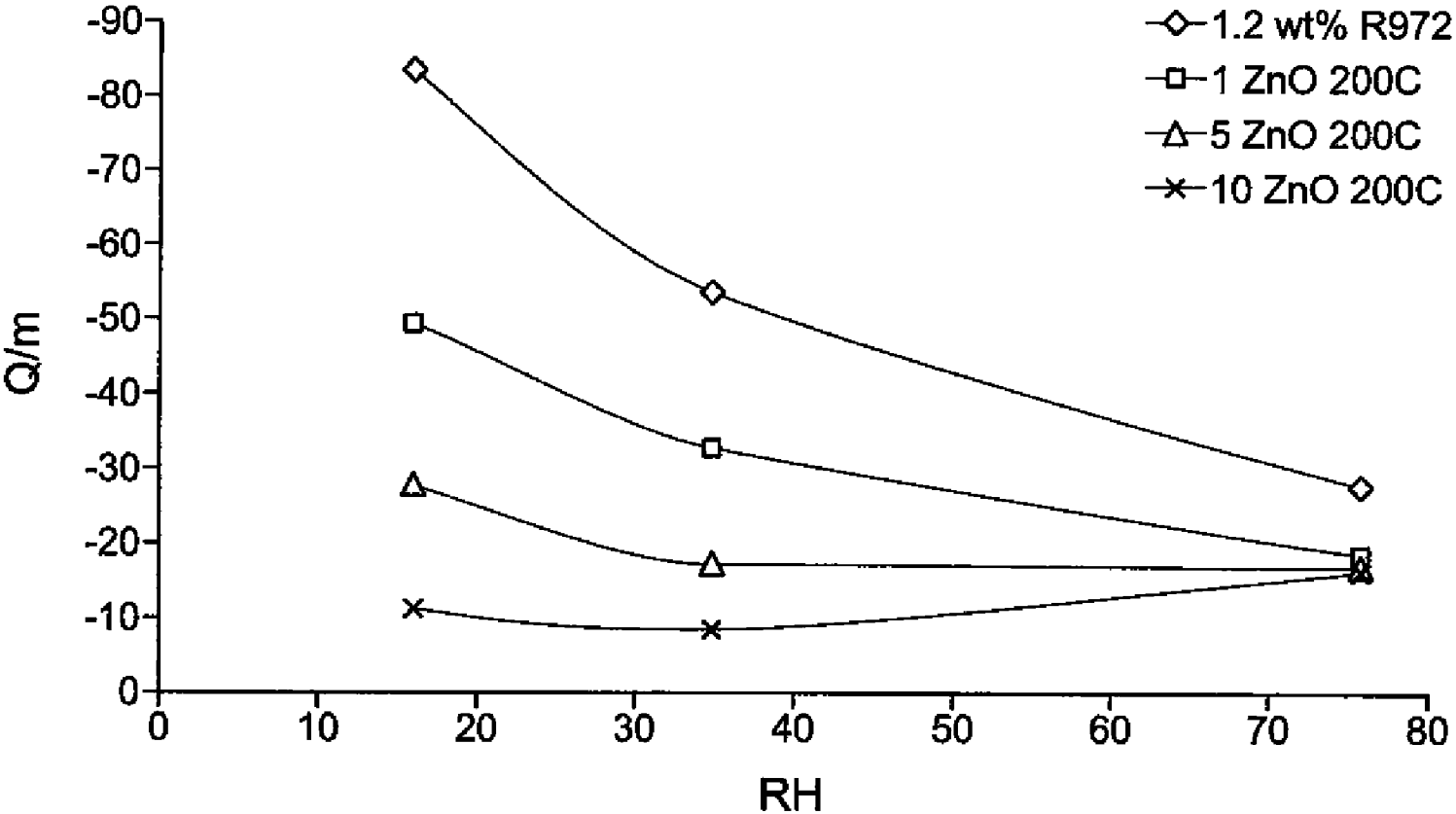
FIG. 4 shows the relative humidity relationship of toners and developers surface treated with silica and zinc oxide processed at 200° C.

The nitrate ligand effect on tribocharging is apparent in the room temperature results (FIG. 3). The intrinsic negative charge of the silica is expressed at the lowest loading of zinc nitrate, and gradually diminishes at higher loading. The tribocharges on these materials are not useful. At 200° C. (FIG. 4) the nitrate appears to still have some effect in lowering the charge, however, no positive charges are observed. Higher loadings decrease charge and the RH response.

Figure 5:
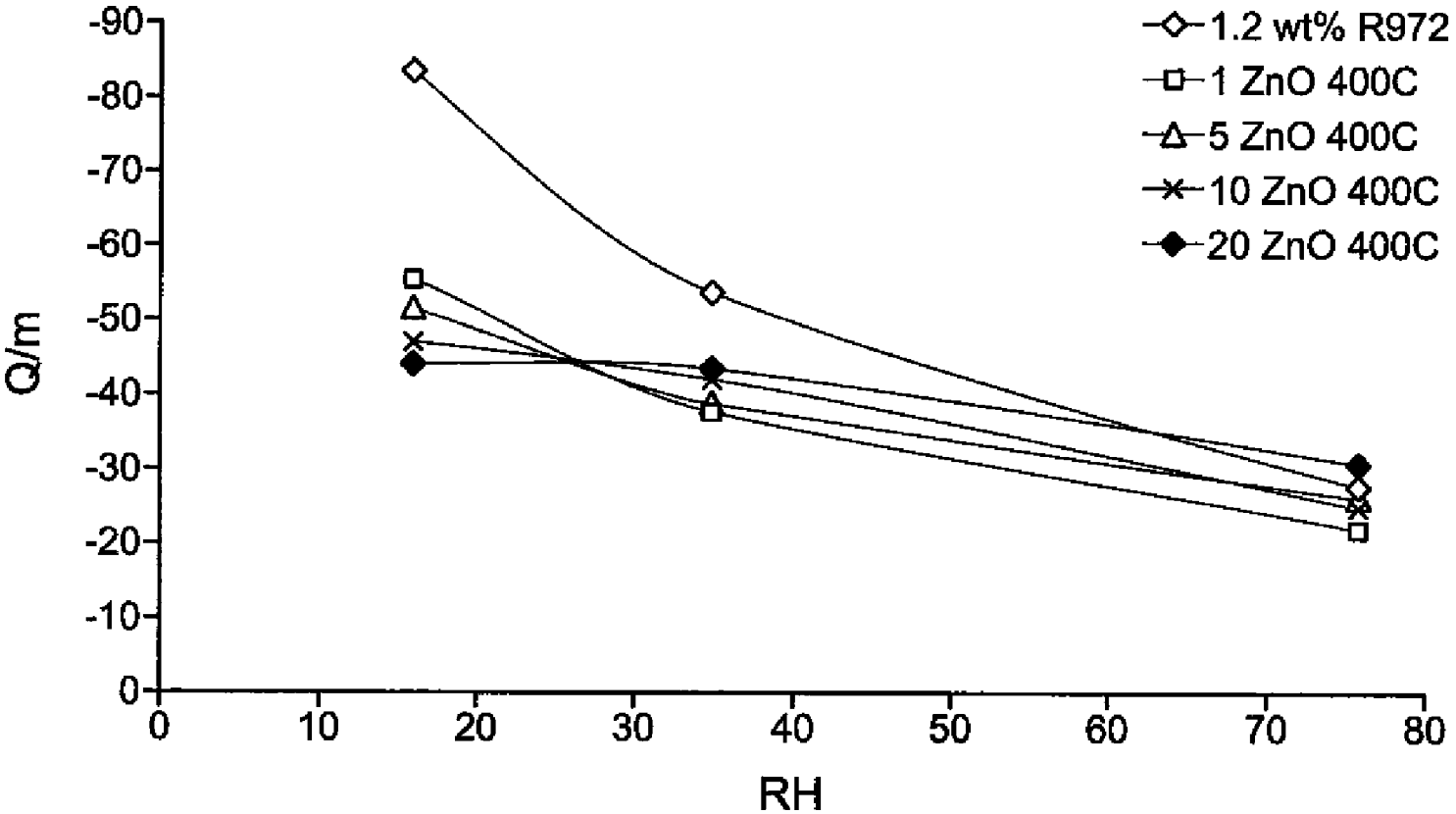
FIG. 5 shows the relative humidity relationship of toners and developers surface treated with silica and zinc oxide processed at 400° C.

The 400° C. (FIG. 5) firings show improved performance especially at the 20 pph loading.

Figure 6:
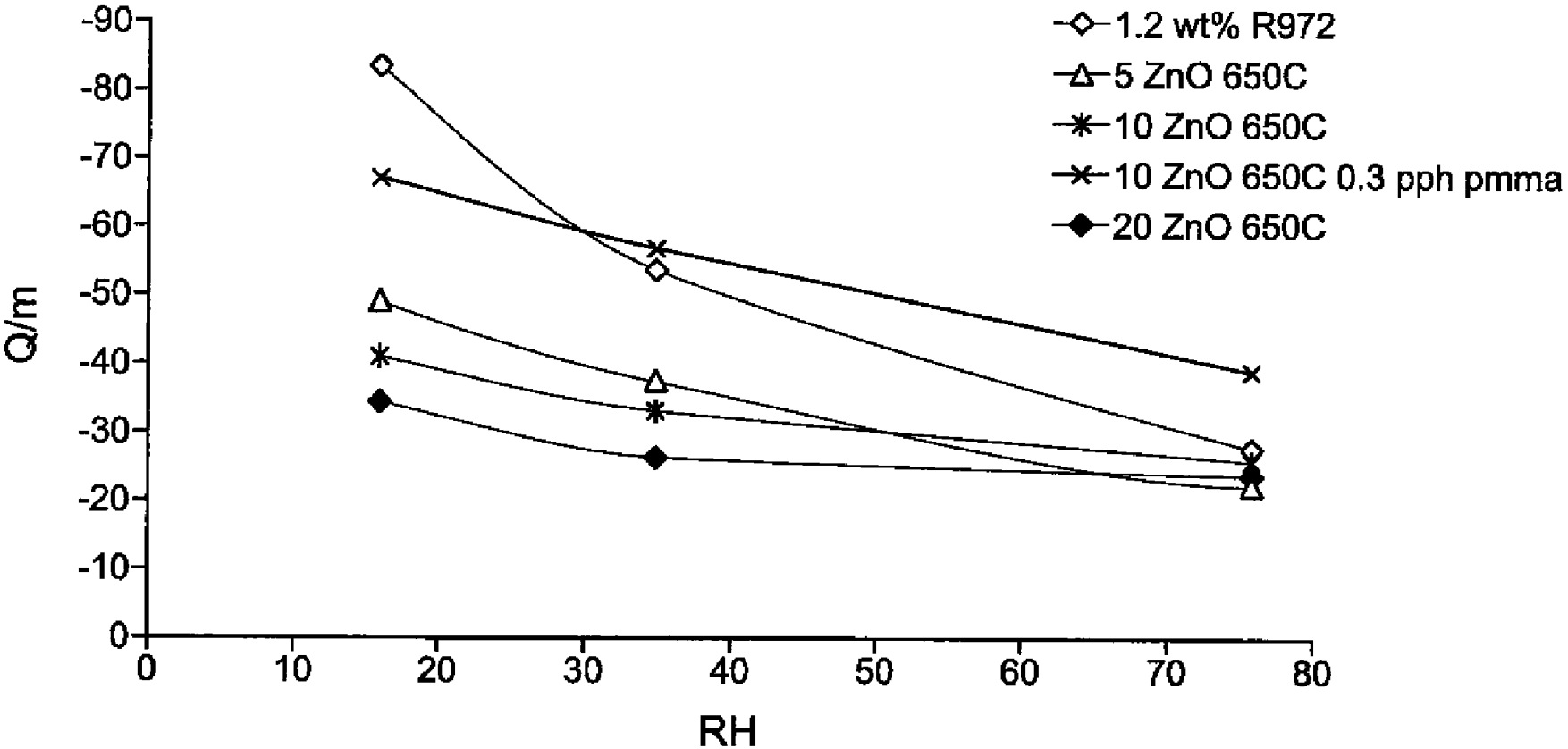
FIG. 6 shows the relative humidity relationship of toners and developers surface treated with silica and zinc oxide processed at 650° C.

The 650° C. (FIG. 6) firings show flatter RH response with a clear concentration effect. The solid blue line is the response using a lower coverage carrier (0.3 pph pmma). The RH response is identical in slope to that of the 1.25 pph 60/40 Kynar/pmma carrier.

In Table 5 there are replicates and comparison samples. Example 10 is a silica sample that was milled in a Trost mill. Examples 19 and 20 are repeats; Examples 24 and 25 are repeats; and Example 27 and 28 are repeats. Example 29 is a 2% loading of the surface treated surface treatment.

The optimum loading and calcining temperature will likely be dependent on the mixing technique and conditions, and as seen with the nitrate salt, source characteristics.

A Silverstone mixer was used for the dispersion of the silica and zinc nitrate in methanol. The volume of solution was increased from 100 ml to 10 g of Aerosil to 125 and 150 ml (designated as diluted). Each of these solutions was shear thinned by the mixer. These preparations gave flat RH response as seen in Table 5 below.

TABLE 5

Silverstone Mixer with Zinc Nitrate

| SAMPLE ID | Ex | Temp/ RH | Q/M | TC | T.O. | Temp/ RH | Q/M | TC | T.O. | Temp/ RH | Q/M | TC | T.O. | RH Slope |
|---|---|---|---|---|---|---|---|---|---|---|---|---|---|---|
| 20 pph ZnO 400 C. | 31 | 58/16 | −33.5 | 6.1 | 0.3 | 76/35 | −32.0 | 4.6 | 1.0 | 80/76 | −33.2 | 4.5 | 4.9 | 0.005 |
| 20 pph ZnO 400 C. diluted | 32 | 58/16 | −36.1 | 6.1 | 0.2 | 76/35 | −34.1 | 5.1 | 1.4 | 80/76 | −33.3 | 4.3 | 4.3 | 0.047 |
| 20 pph ZnO 650 C. | 33 | 58/16 | −40.3 | 5.9 | 0.0 | 76/35 | −38.0 | 4.4 | 0.6 | 80/76 | −30.8 | 4.9 | 3.1 | 0.158 |
| 20 pph ZnO 650 C. diluted | 34 | 58/16 | −40.0 | 6.0 | 0.2 | 76/35 | −38.3 | 5.1 | 0.7 | 80/76 | −38.0 | 5.1 | 4.3 | 0.033 |

The 20 pph ZnO 400° C. 125 ml formulation in Example 31 shows lower charging with higher surface treatment level on the toner, with slightly higher RH dependence. Changing to a higher charging carrier yields higher RH dependence at 2 wt % surface treatment. The results are shown in Table 6 below:

TABLE 6

Higher Toner Surface Treatment level and Higher Charging Carrier

| DESCRIPTION | Ex | Temp/ RH | Q/M | TC | T.O. | Temp/ RH | Q/M | TC | T.O. | Temp/ RH | Q/M | TC | T.O. | RH Slope |
|---|---|---|---|---|---|---|---|---|---|---|---|---|---|---|
| 1% 20 pph ZnO 400 C. | 31 | 58/16 | −33.5 | 6.1 | 0.3 | 76/35 | −32.0 | 4.6 | 1.0 | 80/76 | −33.2 | 4.5 | 4.9 | 0.005 |
| 2% 20 pph ZnO 400 C. | 35 | 58/16 | −29.3 | 5.9 | 0.7 | 76/35 | −22.8 | 5.4 | 2.3 | 81/80 | −19.8 | 5.2 | 17.0 | 0.148 |
| 3% 20 pph ZnO 400 C. | 36 | 58/16 | −24.7 | 5.9 | 0.8 | 76/35 | −18.8 | 5.4 | 3.3 | 81/80 | −17.4 | 4.5 | 21.9 | 0.114 |
| 2% 20 pph ZnO 400 C. on 0.3 pph pmma carrier | 37 | 58/16 | −65.3 | 5.9 | 0.2 | 76/35 | −50.5 | 5.5 | 1.5 | 81/83 | −32.3 | 6.1 | 3.1 | 0.516 |

Other uncoated fumed silicas (Aerosil 200 and 300) also respond to higher loadings of ZnO and high firing conditions. The materials in Table 7 were made from zinc nitrate in methanol along with Silverstone mixing:

TABLE 7

Higher surface area Aerosil Silicas

| SAMPLE ID | Ex | Temp/ RH | Q/M | TC | T.O. | Temp/ RH | Q/M | TC | T.O. | Temp/ RH | Q/M | TC | T.O. | RH Slope |
|---|---|---|---|---|---|---|---|---|---|---|---|---|---|---|
| 20 pph ZnO 400 C. A200 | 38 | 62/10 | −48.2 | 6.0 | 0.0 | 70/37 | −42.7 | 4.7 | 1.2 | 80/72 | −45.3 | 5.4 | 1.9 | 0.047 |
| 20 pph ZnO 400 C. A300 | 39 | 62/10 | −45.6 | 5.8 | 0.0 | 70/37 | −44.1 | 5.6 | 0.6 | 80/72 | −35.5 | 4.9 | 1.5 | 0.163 |
| 20 pph ZnO 650 C. A300 | 40 | 62/10 | −44.7 | 6.1 | 0.1 | 70/37 | −46.5 | 5.2 | 0.4 | 80/72 | −31.6 | 4.9 | 2.1 | 0.211 |

The materials in Table 7 also maintain the RH performance advantage at higher toner loadings as shown in Table 8 below:

TABLE 8

Higher surface area Aerosil Silicas at Higher Toner Loadings

| DESCRIPTION | Ex | Temp/ RH | Q/M | TC | T.O. | Temp/ RH | Q/M | TC | T.O. | Temp/ RH | Q/M | TC | T.O. | RH Slope |
|---|---|---|---|---|---|---|---|---|---|---|---|---|---|---|
| 2% A200 400 C. 20 pph | 41 | 63/7 | −54.3 | 5.8 | 0.0 | 72/35 | −35.8 | 4.9 | 1.2 | 80/83 | −18.8 | 5.4 | 3.4 | 0.467 |
| 2% A300 400 C. 20 pph | 42 | 63/7 | −47.7 | 6.7 | 0.0 | 72/35 | −42.8 | 5.8 | 1.1 | 80/83 | −28.5 | 3.9 | 3.6 | 0.253 |
| 2% A200 650 C. 20 pph | 43 | 63/7 | −54.4 | 6.1 | 0.0 | 72/35 | −44.1 | 5.8 | 0.5 | 80/83 | −27.6 | 4.1 | 2.6 | 0.353 |
| 2% A300 650 C. 20 pph | 44 | 63/7 | −58.3 | 6.1 | 0.4 | 72/35 | −48.4 | 5.0 | 0.3 | 80/83 | −32.5 | 3.9 | 2.7 | 0.339 |

The ZnO treated silicas described herein are also further distinguished in that the processed materials are not physical mixtures of $SiO_2$ and ZnO, at least not at high calcining conditions. FTIR examination (DRIFTS) shows that the zinc nitrate salt does not decompose to ZnO or $Zn_2SiO_4$, rather, instead, new infrared absorptions appear that are not attributable to any known $ZnO/SiO_2$ crystalline phase.

Figure 7:
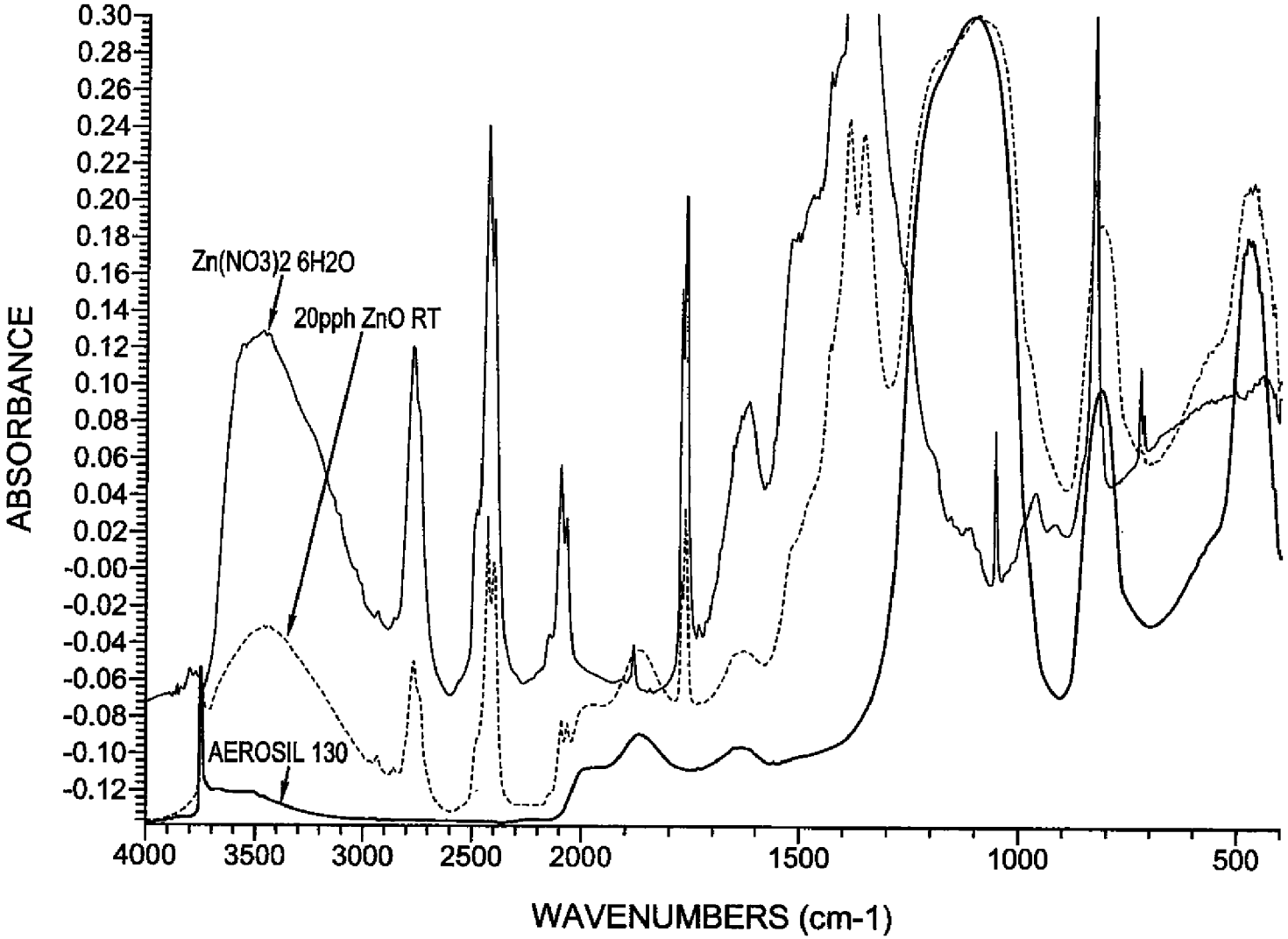
FIG. 7 shows the DRIFT spectra of 20 pph zinc oxide treated silica dried at room temperature.
Figure 8:
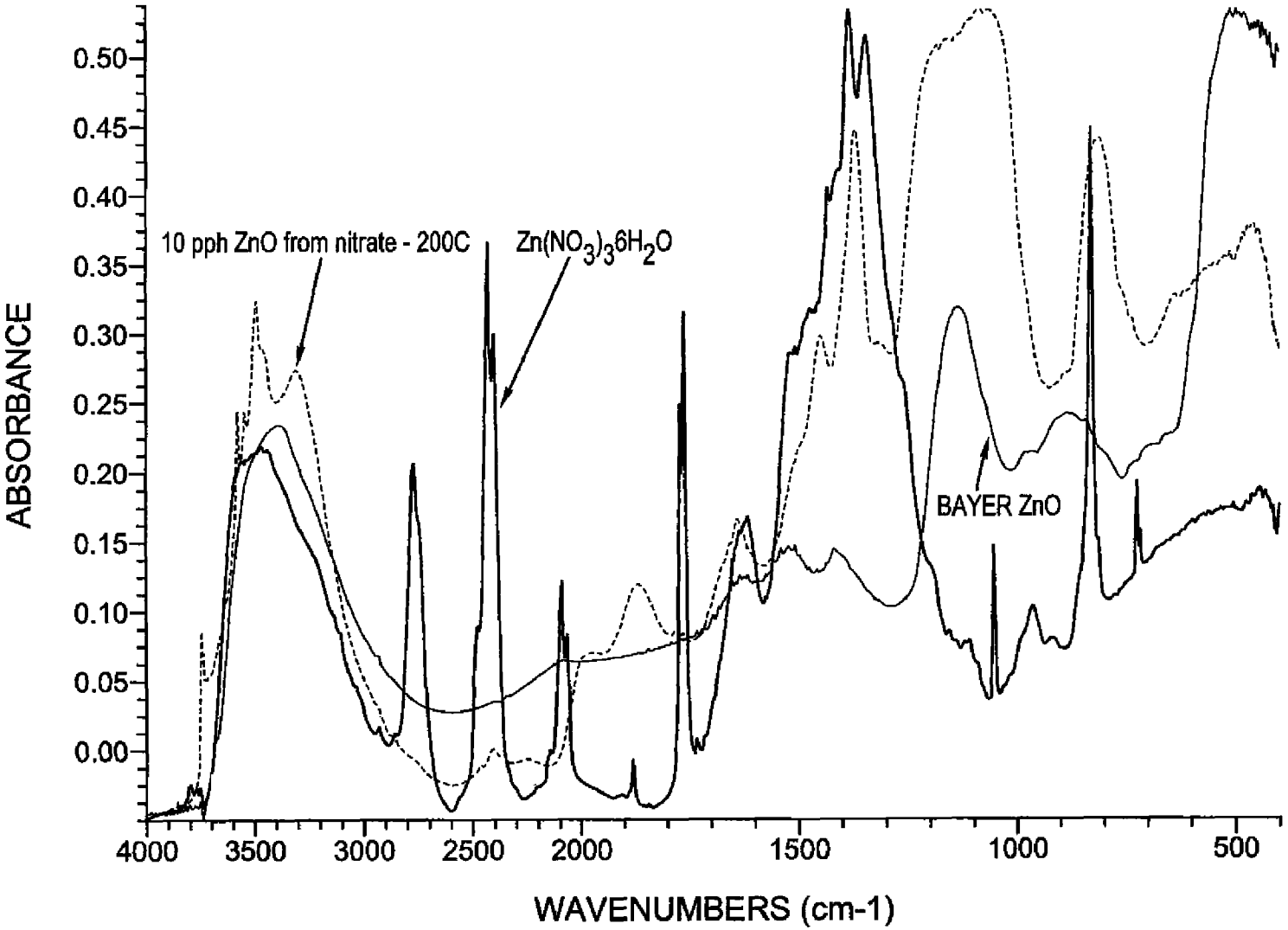
FIG. 8 shows the DRIFT spectra of 10 pph zinc oxide treated silica fired at 200° C.
Figure 9:
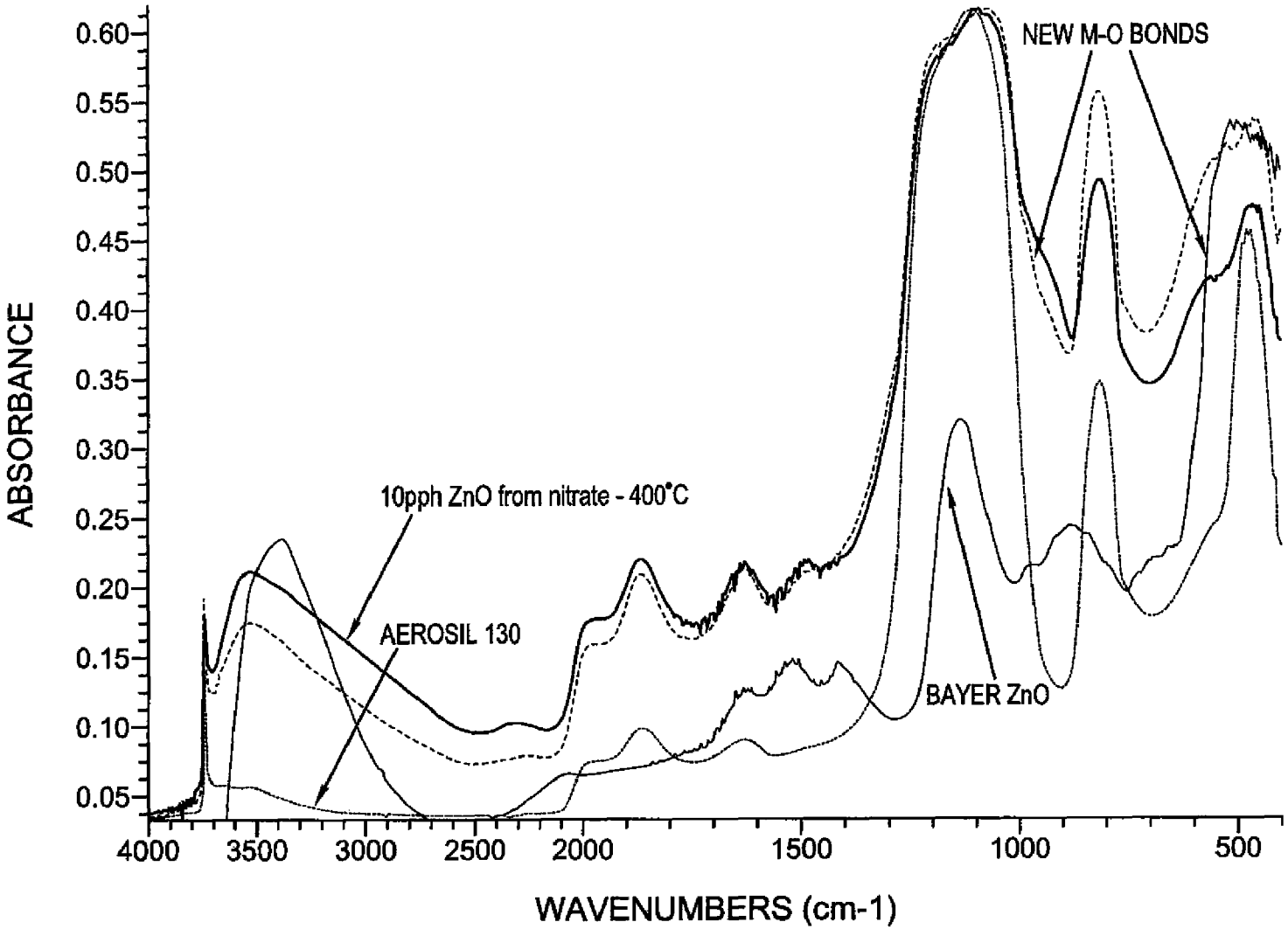
FIG. 9 shows the DRIFT spectra of 10 pph zinc oxide treated silica fired at 400° C.
Figure 10:
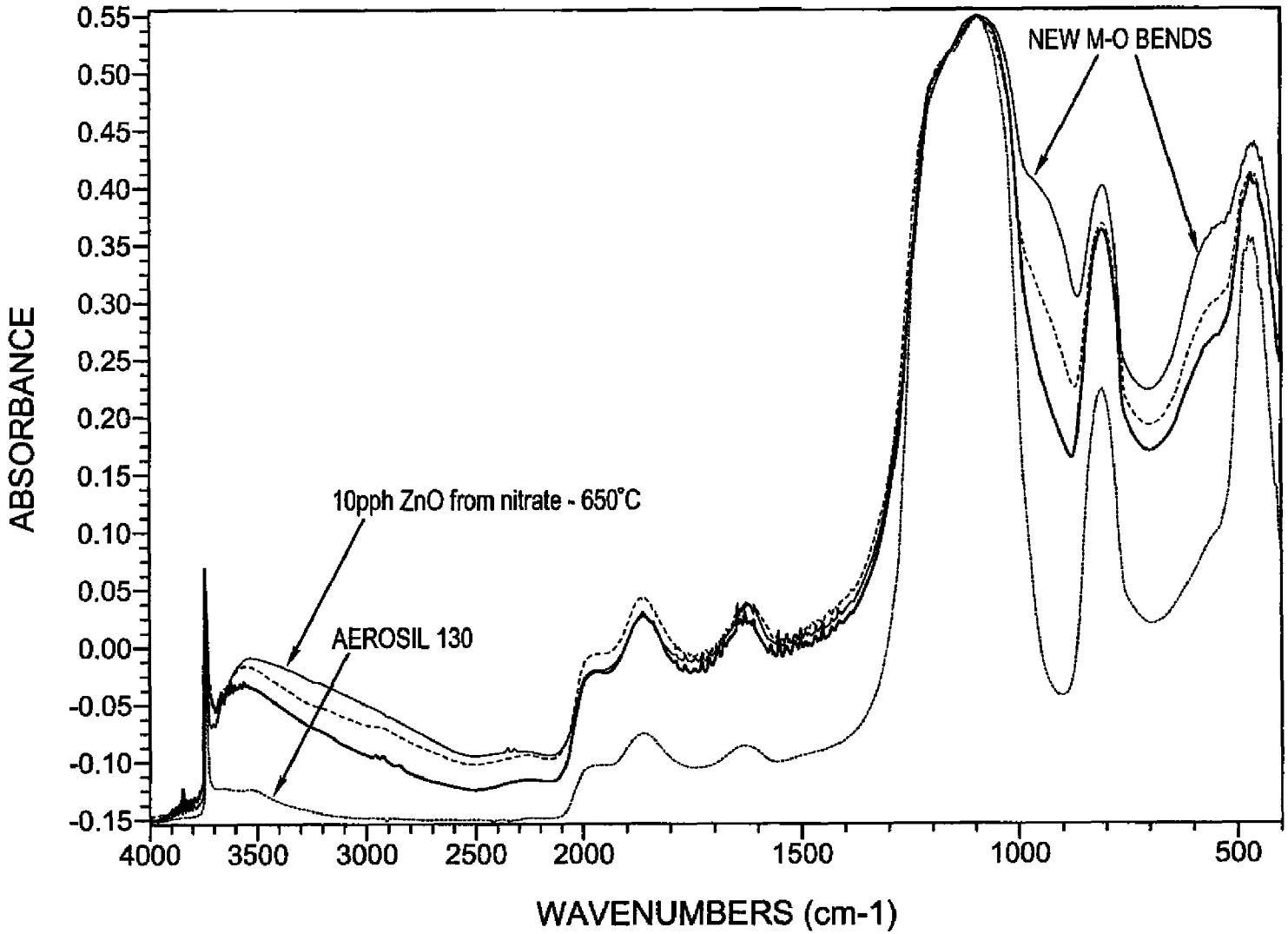
FIG. 10 shows the DRIFT spectra of 10 pph zinc oxide treated silica fired at 650° C.

FIGS. 7-12 show the DRIFTs spectra of ZnO-treated silica with reference spectra of the source nitrate and possible reaction products. FIG. 7 shows room temperature treatment. It indicates a mixture of zinc nitrate and Aerosil 130. FIG. 8 shows a 200° C. treatment of 10 pph ZnO treated silica. The nitrate absorptions are diminished, while correlation with the ZnO reference is ambiguous. In FIG. 9 it can be seen that the 400° C. materials appear similar to the Aerosil 130 with the addition of M-O shoulders at lower energy. The ZnO spectrum does not match that of the ZnO-treated silica. In FIG. 10 is can be seen that the shoulders are more defined in the 650° C. samples.

Figure 11:
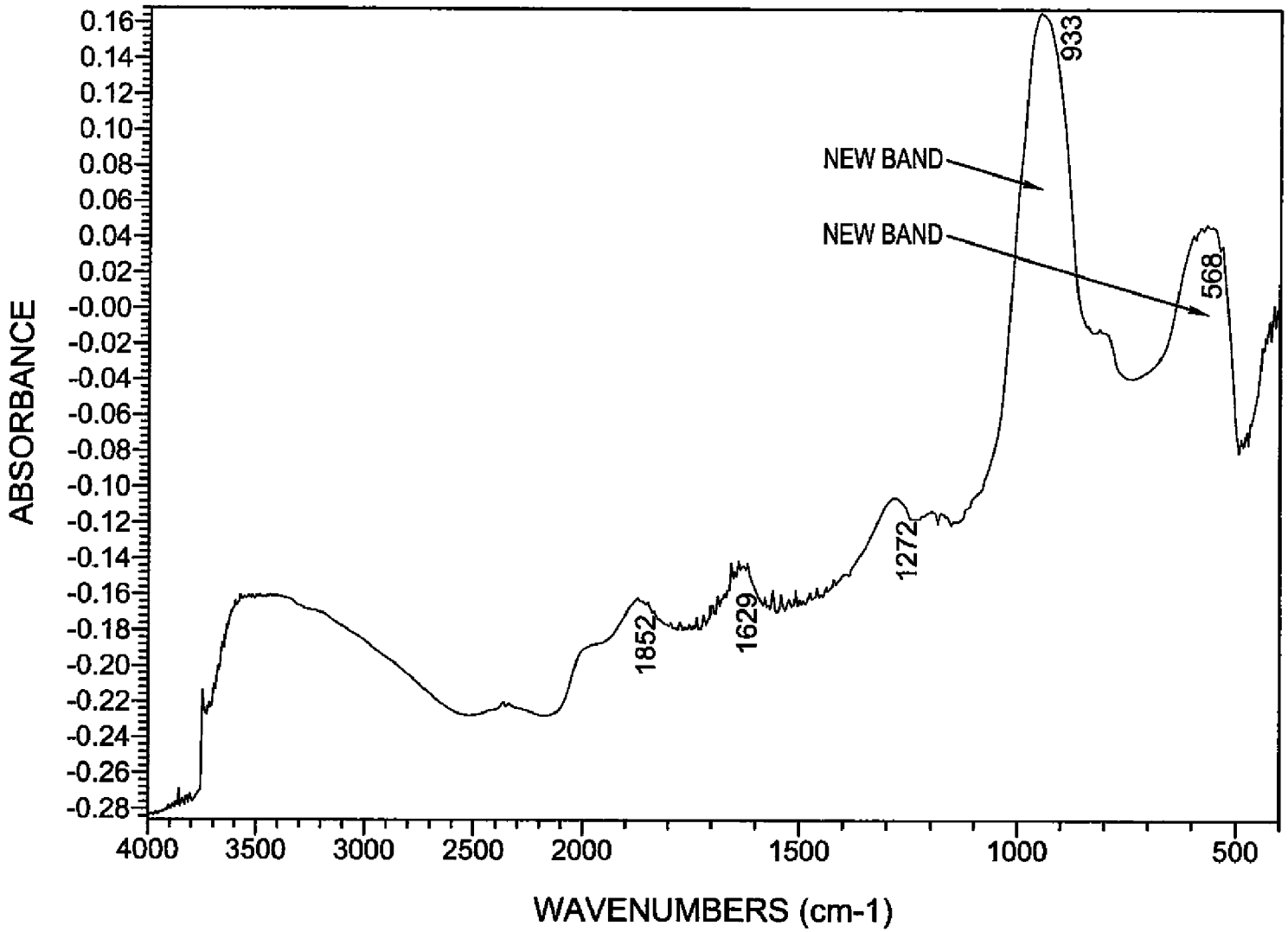
FIG. 11 shows the DRIFT spectra of 10 pph zinc oxide treated silica fired at 650° C. with the Aerosil 650° C. spectrum subtracted.

The unidentified shoulders are visualized by subtraction of the FTIR spectrum of Aerosil A130 fired at 650° C. (FIG. 11). These absorptions are identical to the Si—O—Zn linkages described in Roy et al. (Chem. Eur. J. B2004B, I10I, 1565-1575). The reference details the synthesis of nanocrystalline zinc silicate by chemical vapor deposition of a single source precursor. At high deposition temperatures or sintering conditions the product can be crystalline $\alpha$-$Zn_2SiO_4$, $\beta$-$Zn_2SiO_4$, or possibly $Zn_{1.7}SiO_4$ as determined by x-ray diffraction. The corresponding FTIR examination shows that the uncrystallized products from lower thermal treatments exhibit broad peaks at 940 $cm^{-1}$ and 560 $cm^{-1}$ that evolve to a structured set of absorption when the zinc silicate phases crystallize. This is the identical behavior observed for the ZnO treated Silica surface treatments of this application. The authors propose that these are Zn—O—Si vibrational modes, and support the claim with solid state NMR analysis. Note, the authors do not mention surface treatment or electrographic applications, or any tribocharging or particle behavior that can be related to these fields.

Figure 12:
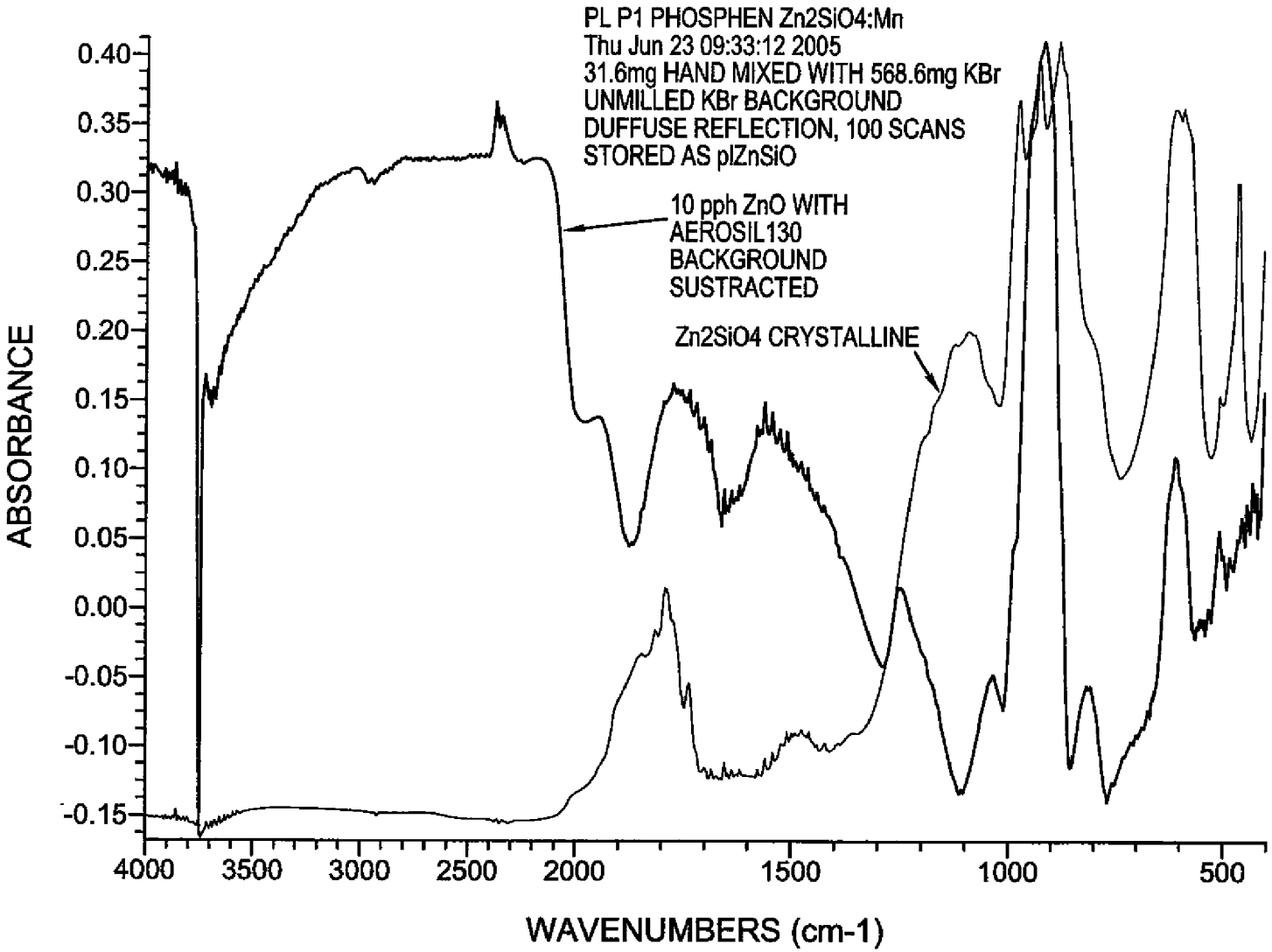
FIG. 12 shows the DRIFT spectra of 10 pph zinc oxide treated silica fired at 900° C. (Blue line) with the Aerosil 130 spectrum subtracted compared to that of crystalline Zn2SiO4.

FIG. 12 is an FTIR comparison of crystalline $Zn_2SiO_4$ and a 20 pph ZnO A130 sample fired at 900° C. The latter exhibits low, impractical, tribocharges (<−10 μC/g) and high dusting across the RH range.

X-ray diffraction was used to examine several process and formulation conditions. The phase analysis is summarized in Table 9 below:

TABLE 9

| | X-ray Diffraction | | | |
|---|---|---|---|---|
| Example and Description | Zn2SiO4 | Zn2SiO4 | ZnO | Amorphous |
| Ex 45 Aerosol 130 | | | | Major |
| Ex 46 Aerosol 130 650 C. | | | | Major |
| Ex 47 20 pph ZnO on Aerosol 130 400 C. | | | Possible Trace | Major |
| Ex 48 20 pph ZnO on Aerosol 130 650 C. | | | Possible Trace | Major |
| Ex 49 20 pph ZnO on Aerosol 130 650 C. | | | | Major |
| Ex 50 30 pph ZnO on Aerosol 130 650 C. | | | Moderate | Major |
| Ex 51 50 pph ZnO on Aerosol 130 650 C. | | | Major | Major |
| Ex 52 20 pph ZnO on Aerosol 130 900 C. | Major | Major | | Major |
| Ex 53 $Zn_2SiO_4$ (Sylvania Phosphor) | | Major | | |

Examples 45 and 46 show that the Aerosil 130 control material is amorphous as received nor does it crystallize at the firing temperatures up to 650° C. Also note that amorphous phase(s) are observed in all the samples. This is expected since even at 50 pph ZnO, there is still a considerable molar excess of silica.

Examples 47, 48, 49 and 52 were made from a methanol solution, and exhibited the best RH performance. The first three materials are amorphous by diffraction, and in the FTIR we observe the two broad peaks in the FTIR associated with a possible Zn—O—Si linkage in addition to the finned silica absorptions. The 900° C. sample has sharp FTIR peaks similar to those of $Zn_2SiO_4$, and this is confirmed by x-ray diffraction. As mentioned previously, this sample is very low charged and is not practical. The 50 and 51 examples each show ZnO as a crystalline phase, with the 50 pph sample showing a more of this phase.

Other Preparative Routes:

The present preparation, consisting of a solution treatment, calcining and milling, is divergent from what was previously known in the art. Based on the ZnO—$SiO_2$ analysis above it should be mentioned that other preparative routes that could yield Zn—O—Si linkages, particularly amorphous materials. Flame co-pyrolysis and chemical vapor decomposition of precursor molecules are known (US 2003/0190543A1 and Roy et al.) are examples of ZnO—$SiO_2$ preparative routes. More sophisticated flame or fuming processes where the silica is reacted with a volatilized Zn source, and modified solution processes in which the morphology and particle size of the source silica is maintained are also anticipated.

The invention has been described in detail with particular reference to certain preferred embodiments thereof, but it will be understood that variations and modifications can be effected within the spirit and scope of the invention.

The invention claimed is:

1. A method treating toner particles comprising:

forming a mixture of silica and zinc salt and a solvent;

drying the mixture;

grinding the dried mixture;

heating the mixture at a temperature of from 200 to 900° C. to form a surface treatment composition;

providing toner particles to be surface treated; and surface treating the toner particles with the formed surface treatment composition.

2. The method of claim 1 wherein the temperature of heating is from 400 to 650° C.

3. The method of claim 1 wherein the solvent comprises methanol.

4. The method of claim 1, wherein the surface treatment composition exhibits a fourier transform infrared major peak at 940 $cm^{-1}$ and a weaker peak at 560 $cm^{-1}$ and is amorphous to X-rays.

5. The method of claim 4 wherein the silica comprises fumed silica.

6. A developer for developing electrostatic latent images, comprising toner particles treated with a surface treatment composition comprising:

silica and amorphous zinc silicate obtained by the method of claim 1.

7. The developer of claim 6 wherein the silica comprises fumed silica.

8. The developer of claim 7, wherein the surface treatment composition exhibits a fourier transform infrared major peak at 940 $cm^{-1}$ and a weaker peak at 560 $cm^{-1}$ and is amorphous to X-rays.

9. A toner comprising toner particles treated with a surface treatment composition comprising: silica and amorphous zinc silicate obtained by the method of claim 1.

10. The toner of claim 9 wherein the silica comprises fumed silica.

11. The toner of claim 10, wherein the surface treatment composition exhibits a fourier transform infrared major peak at 940 $cm^{-1}$ and a weaker peak at 560 $cm^{-1}$ and is amorphous to X-rays.

* * * * *